US008156973B2

(12) United States Patent
Stepp

(10) Patent No.: US 8,156,973 B2
(45) Date of Patent: Apr. 17, 2012

(54) WOOD WORKING MACHINE

(76) Inventor: Lewis E. Stepp, Cincinnati, OH (US)

( * ) Notice: Subject to any disclaimer, the term of this patent is extended or adjusted under 35 U.S.C. 154(b) by 202 days.

(21) Appl. No.: 12/685,112

(22) Filed: Jan. 11, 2010

(65) Prior Publication Data

US 2010/0108194 A1 May 6, 2010

Related U.S. Application Data

(63) Continuation-in-part of application No. 12/362,551, filed on Jan. 30, 2009, now Pat. No. 7,997,308.

(60) Provisional application No. 61/024,716, filed on Jan. 30, 2008, provisional application No. 61/089,596, filed on Aug. 18, 2008.

(51) Int. Cl.
*B27C 5/00* (2006.01)

(52) U.S. Cl. ..... 144/145.1; 144/144.1; 144/136.1

(58) Field of Classification Search ..... 144/135.2, 144/136.1, 143, 144.1, 144.51, 144.52, 145.1, 144/85–90, 3.1; 409/79, 125, 130
See application file for complete search history.

(56) References Cited

U.S. PATENT DOCUMENTS

| | | | |
|---|---|---|---|
| 3,109,466 | A | 11/1963 | Jones |
| 4,995,435 | A | 2/1991 | Godfrey |
| 5,285,832 | A | 2/1994 | Gibson |
| 5,318,082 | A | 6/1994 | Von Hollen |
| 5,458,171 | A | 10/1995 | Ward |
| 5,598,878 | A | 2/1997 | Wirth, Jr. et al. |
| 5,931,208 | A | 8/1999 | Gifkins |
| 6,012,497 | A | 1/2000 | Stottmann |
| 6,032,706 | A | 3/2000 | Lear |

(Continued)

FOREIGN PATENT DOCUMENTS

GB 369776 3/1932

(Continued)

OTHER PUBLICATIONS

U.S. Appl. No. 12/362,551, filed Jan. 30, 2009, Lewis E. Stepp.

*Primary Examiner* — Shelley Self
(74) *Attorney, Agent, or Firm* — Hasse & Nesbitt LLC; Donald E. Hasse

(57) ABSTRACT

A wood working machine is described that includes a mounting plate assembly for supporting a cutting tool, the mounting plate assembly including a base plate, first and second spaced apart intermediate plates on the base plate, and first and second guide plate elements pivotally supported on respective first and second intermediate plates, and a cutting tool support plate slidably disposed between the first and second guide plate elements, the guide plate elements including means defined therein for positioning each of the guide plate elements at selected angular intervals with respect to the respective first and second intermediate plates, whereby the cutting tool support plate is slidably movable on the base plate between the guide plate elements at a prescribed angle. The mounting plate assembly may include laser sources providing crossed laser beams for accurately positioning the tool bit of the cutting tool near a work piece, and light sources for illuminating the tool bit. A digital sensor may be included for precise positioning of the work piece held beneath the base plate on a movable carrier. Work holding fixtures such as a mortising plate or multiangle work holder may be optionally attached to the moveable carrier to hold the work piece in alternative ways.

20 Claims, 13 Drawing Sheets

U.S. PATENT DOCUMENTS

| | | | | |
|---|---|---|---|---|
| 6,148,880 | A | 11/2000 | Dehde et al. | |
| 6,315,017 | B1 | 11/2001 | Stottmann | |
| 6,488,062 | B1 | 12/2002 | Aigner | |
| 6,588,468 | B1 | 7/2003 | Tucker et al. | |
| 6,899,152 | B2 | 5/2005 | Godfrey | |
| 7,143,795 | B1 | 12/2006 | Davis | |
| 7,997,308 | B2 * | 8/2011 | Stepp | 144/3.1 |
| 2003/0196726 | A1 | 10/2003 | Tucker et al. | |
| 2004/0050451 | A1 * | 3/2004 | Dahlhoff | 144/144.1 |

FOREIGN PATENT DOCUMENTS

| | | |
|---|---|---|
| GB | 1128998 | 10/1968 |
| JP | 05-337905 | 12/1993 |
| JP | 12-176907 | 6/2000 |
| KR | 10-2000-0068547 | 11/2000 |

* cited by examiner

WOOD WORKING MACHINE

CROSS-REFERENCE TO RELATED APPLICATIONS

This application is a continuation-in-part of application Ser. No. 12/362,551, filed on Jan. 30, 2009, now U.S. Pat. No. 7,997,308, which claims the benefit of U.S. Provisional Application Nos. 61/024,716, filed Jan. 30, 2008 and 61/089,596, filed Aug. 18, 2008, the disclosures of which are incorporated herein by reference in their entirety.

FIELD OF THE INVENTION

This invention relates generally to woodworking machines, jigs and related woodworking tools, and more particularly to a versatile wood working machine for precisely cutting dovetail joints, mortises, tenons, box joints, raised panels and other joint configurations without the limitations and expense of manufactured templates. The invention also relates to and in performing other wood working procedures in the fabrication of cabinetry or other structures comprising wood.

BACKGROUND OF THE INVENTION

In the fabrication of cabinetry, furniture, shelving and other objects of wood, the joining of individual wood pieces using dovetail or box joints, and joints using mortise and tenon, and related joints is in common practice. Existing woodworking machines may include wood cutting devices such as routers mounted on a jig in order to accomplish the cutting of the joints. It is of course an object of the woodworking process to cut precise tightly fitting joints of desired shape and size. However, a deficiency in prior art woodworking machines and processes has resided in the inability to fabricate precisely fitting joints without the aid of templates or manufactured patterns, particularly of the dovetail type. There is, therefore, a demonstrated need in the art for a woodworking machine that can provide both the desired versatility and the desired precision in fabrication of dovetail and other type joints in the fabrication of cabinetry, furniture, shelving or other objects of wood.

SUMMARY OF THE INVENTION

According to a first aspect of the present invention, there is provided a woodworking machine comprising, a support;

a movable carrier on said support; and a mounting plate assembly attachable to said support for supporting a cutting tool, said mounting plate assembly including a base plate having means for attachment to said support, and including first and second intermediate plates on said base plate and defining a space therebetween, and including first and second guide plate elements pivotally supported on respective first and second intermediate plates, and including a cutting tool support plate slidably disposed between said first and second guide plate elements, said guide plate elements including means defined therein for positioning each of said guide plate elements at selected angular intervals with respect to respective said first and second intermediate plates, whereby said cutting tool support plate is slidably movable on said base plate between said guide plate elements at a selected angle relative to said movable carrier.

According to a second aspect of the present invention, there is provided a woodworking machine comprising, a support;

a movable carrier on said support;

clamping means attachable to said movable carrier for holding a work piece; and a mounting plate assembly attachable to said support for supporting a cutting tool, said mounting plate assembly including a base plate having means for attachment to said support, and including first and second intermediate plates on said base plate and defining a space therebetween, and including first and second guide plate elements pivotally supported on respective first and second intermediate plates, and including a cutting tool support plate slidably disposed between said first and second guide plate elements, said guide plate elements including means defined therein for positioning each of said guide plate elements at selected angular intervals with respect to respective said first and second intermediate plates, whereby said cutting tool support plate is slidably movable on said base plate between said guide plate elements at a selected angle relative to said movable carrier.

According to a yet another aspect of the present invention, a woodworking machine is provided that comprises, a support;

a movable carrier on said support;

a mounting plate assembly attachable to said support for supporting a cutting tool, said mounting plate assembly including a base plate having means for attachment to said support, and including first and second intermediate plates on said base plate and defining a space therebetween, and including first and second guide plate elements pivotally supported on respective first and second intermediate plates, and including a cutting tool support plate slidably disposed between said first and second guide plate elements, said guide plate elements including means defined therein for positioning each of said guide plate elements at selected angular intervals with respect to respective said first and second intermediate plates, whereby said cutting tool support plate is slidably movable on said base plate between said guide plate elements at a selected angle relative to said movable carrier; and a mortising plate (horizontal work holder) attachable to said movable carrier beneath said mounting plate assembly for supporting a work piece thereon.

According to a yet another aspect of the present invention, an improvement in woodworking machines is provided that comprises a mounting plate assembly attachable to said support for supporting a cutting tool, said mounting plate assembly including a base plate having means for attachment to said support, and including first and second intermediate plates on said base plate and defining a space therebetween, and including first and second guide plate elements pivotally supported on respective first and second intermediate plates, and including a cutting tool support plate slidably disposed between said first and second guide plate elements, said guide plate elements including means defined therein for positioning each of said guide plate elements at selected angular intervals with respect to respective said first and second intermediate plates, whereby said cutting tool support plate is slidably movable on said base plate between said guide plate elements at a selected angle.

In yet another aspect of the invention, an improvement in woodworking machines having a movable carrier for supporting a workpiece in a wood working operation is provided and comprises a mortising plate attachable to the movable carrier, the mortising plate having a slotted surface and adapted for attachment to the movable carrier wherein the slotted surface is disposed either horizontally or vertically with respect to the movable carrier.

A feature of the machine of the invention comprises an arrangement for digitally sensing the position of the movable carrier, including a beam attached to the movable carrier and adapted for movement therewith, a digital sensor disposed near said elongated beam for sensing the position of said elongated beam, and digital readout means operatively connected to said digital sensor for receiving signals from said digital sensor defining position of said beam.

A wood working machine structured according to any embodiment of the invention overcomes many limitations characteristic of prior art machines. For example, a machine of the invention can use substantially any size cutting (router) bit, can accommodate a large range of wood thicknesses at substantially any length, and can accommodate dovetail cutting operations for any number of pins at any spacing. The machine can be wall mounted for convenience of access and operation and for economy of workspace.

DESCRIPTION OF THE DRAWINGS

The invention will be more fully understood by a reading of the following detailed description of the invention read in conjunction with the accompanying drawings that form a part of this application and wherein.

DETAILED DESCRIPTION OF THE INVENTION

Figure 1:
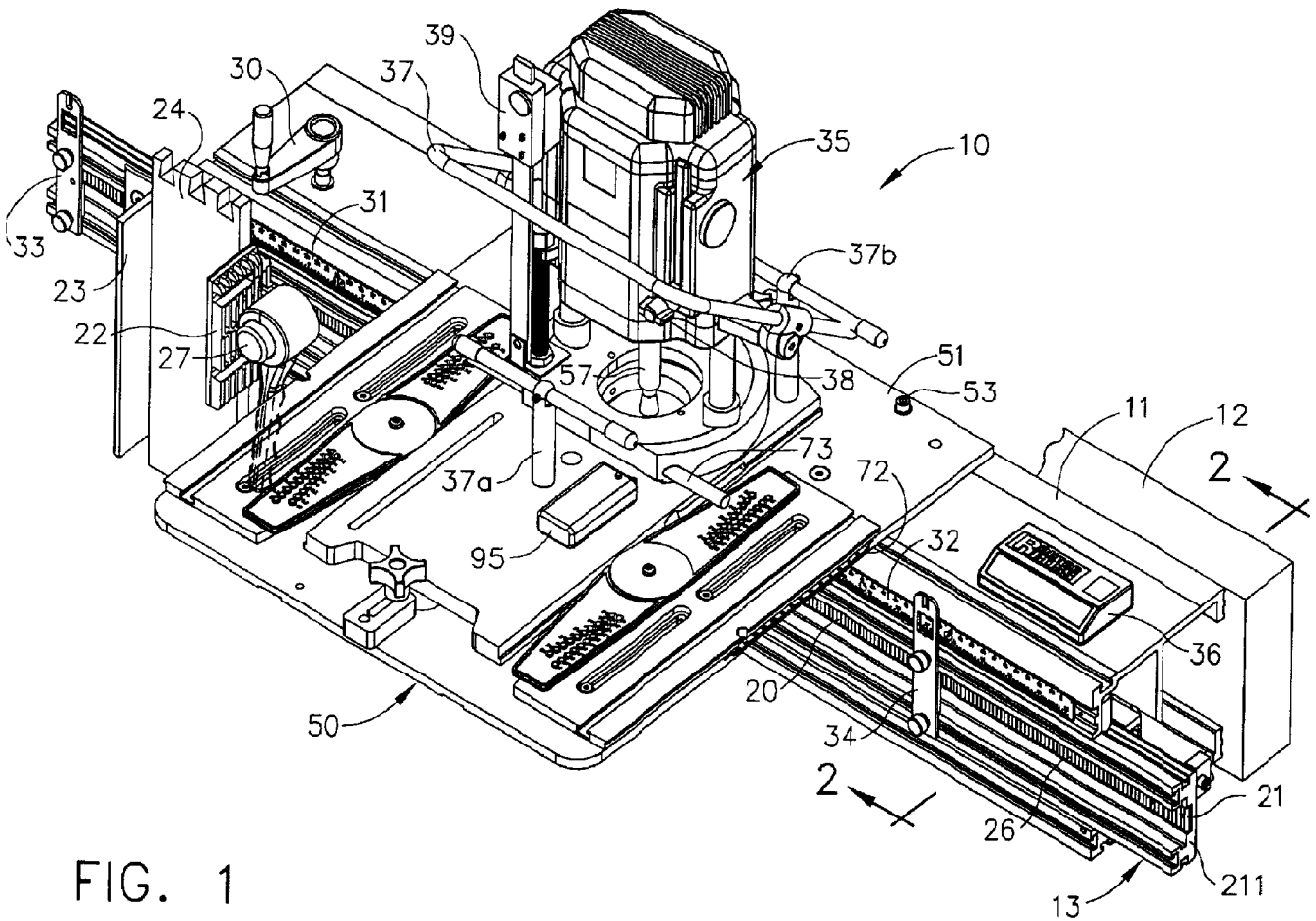
FIG. 1 is a view in perspective of one woodworking machine arrangement incorporating elements in accordance with the present invention.
Figure 2:
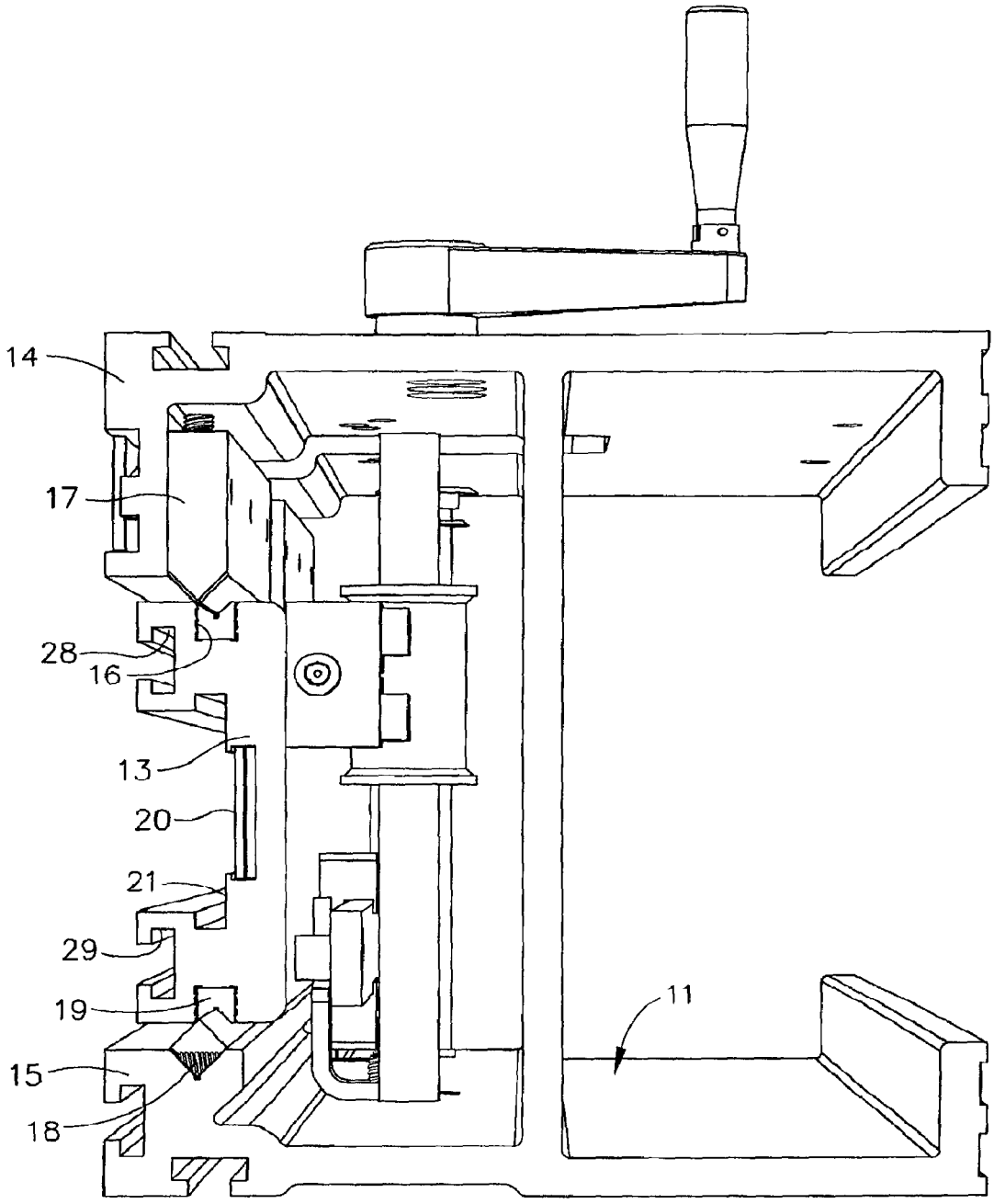
FIG. 2 is an enlarged view in cross section as viewed along lines 2-2 of the machine of FIG. 1 illustrating in detail the structure of the support extrusion and sliding bar carrier supported thereon.

Referring now to the drawings, FIG. 1 shows a perspective view of one woodworking machine 10 arrangement incorporating elements according to the invention. The machine 10 arrangement shown in FIG. 1 is particularly suited for cutting the dovetail pins and sockets in the fabrication of dovetail joints for making cabinetry or the like. Machine 10 includes a carriage support in the form of a heavy aluminum CNC (Computer numerically Controlled) machined extrusion 11 that can be attachable conventionally to a shop table (not shown) or to means such as in the form of a wood beam 12 attachable to a wall in such as a shop area. A movable carrier in the form of sliding bar carrier 13 is slidably supported between two flanges of extrusion 11 as depicted more clearly in FIG. 2 that shows an enlarged view in cross section as viewed along lines 2-2 of the machine 10 of FIG. 1. FIG. 2 shows the detail of the structure of the support extrusion 11 and sliding bar carrier 13 supported thereon. In FIG. 2 it is seen that sliding bar carrier 13 is supported between upper flange 14 and lower flange 15 of extrusion 11. Carrier 13 includes an upper elongated V-groove 16 containing a gasket of plastic, elastomer, nylon or the like for accommodating a vertically adjustable steel V-guide and set screw arrangement 17 attached to upper flange 14. A lower V-groove 19 of plastic, elastomer, nylon or the like riding on a steel V-guide 18 is disposed in lower flange 15 of extrusion 11 for slidable movement thereon of carrier 13. With reference additionally to FIG. 1, it is seen that carrier 13 may support, along the length thereof, first fixed jaw 23 and second movable jaw 22 providing a clamping means for supporting a work piece 24. Also along the length of carrier 13 is defined a toothed track 20 disposed in a lengthwise groove 21 of carrier 13. Second jaw 22 of the clamping means for work piece 24 is secured along toothed track 20 and selectively locked securely against the work piece by means of a set of sprung pawls in rotatable cam lock 27 that engages in ratchet-like fashion the teeth 26 of toothed track 20. Rotating the handle of cam lock 27 then pushing a button (see discussion below with respect to FIG. 14) on the front of the handle releases the lock allowing slidable movement of both second jaw 22 and cam lock 27 along toothed track 20. Carrier 13 further includes a pair of T-slots 28 and 29 (FIG. 2) for attachment of cursors 33 and 34 and for mounting auxiliary attachments (such as described below in relation to FIG. 3 and FIG. 9).

Manual movement of sliding bar carrier 13 is accomplished by means of crank 30 and cable operatively connected to carrier 13. The cable arrangement is such that sliding bar carrier 13 will only move when crank 30 is turned, whereby carrier 13 is effectively held or fixed in position when it is moved from one selected position to another, with precision and without backlash. Selectively positionable scales 31 and 32 attached to extrusion 11 and cursors 33 and 34 attached to sliding bar carrier 13 as suggested in FIG. 1 provide accurate means to assess the position of carrier 13 and the work piece 24 relative to cutting tool 35 (such as a plunge wood router). With the cutting tool at a starting cut position on work piece 24, cursor 33 can be aligned to a starting position on scale 31. Scale 32 with cursor 34 serves as a continuation of scale 31. Effectively scales 31 and 32 may be metric or inch rulings or simply a white board on which erasable marks are placed to which the cursors can be aligned. Alternatively, digital readout 36 may be mounted to machine 10 for extremely precise positioning of carrier 13 (see below discussion relating to FIG. 11). The digital readout 36 provides an electronic scale that can be zeroed at a first cut position with all other cut positions read as an offset from this position. By observation and recording of appropriate digital readout 36 readings, or scales 31 and 32 readings, any series of repetitive cuts using carrier 13 can be accurately positioned. For dovetails, digital readout 36, or scales 31 and 32, can be used to (1) precisely translate a dovetail cut pattern drawn on the end of a board into positional readings, then to (2) repeatably position cuts for both the pins and mating sockets of dovetail joints defined by the said pattern. The same readings are used to locate both the pin and mating socket cuts because the pattern readings are taken with either laser cross hair beams 63*a* and 63*b* (see FIG. 4) or a pointed centering bit such that each reading represents the center of both a socket and its mating pin. Since both the socket and mating pin have the same center, cuts made using the readings will align precisely provided that the intermediate guide rails 65 and 66 remain in place between the socket and pin cuts. (See below discussion relative to FIG. 4).

With reference again to FIG. 1, it is noted that the need to use one-half of a previously cut joint (i.e., socket cuts) as a template guide for the other half of the joint (i.e., pin cuts) in previously existing woodworking machines results in the need to clamp two work pieces at the same time, and this effectively reduces the work piece clamping capacity of the machine by one half. The present invention uses scales 31 and 32 with cursors 33 and 34 or digital readout 36 for positioning cuts with repeatable accuracy without reduction in work piece clamping capacity. Also, unlike prior machines that use a previously cut joint as a template guide for the mating joint, the scales 31 and 32 and digital readout 36 of the present invention can be used for both parts of a mating joint plus the scales and digital readout indicate the exact measurement of each cut from a starting position. This provides an improvement in both versatility and precision over the prior art.

Figure 3:
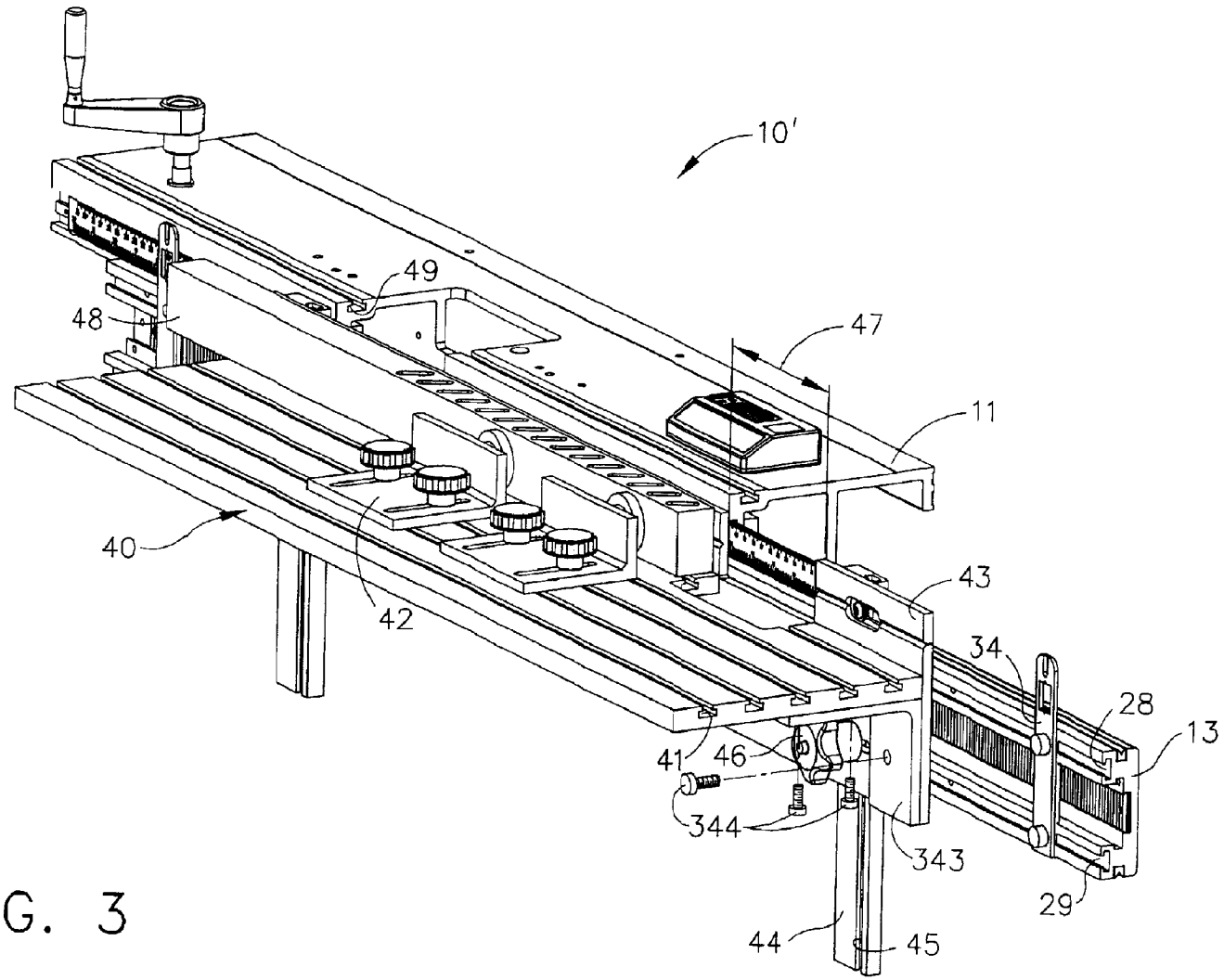
FIG. 3 is a view in perspective of selected components of another woodworking machine arrangement illustrating the inclusion of a horizontal work holder element with the present invention.

Reference is now made to FIG. 3, which is a view in perspective of selected components of a woodworking machine 10' arrangement to illustrate the inclusion of a horizontal work holder in the form of mortising plate 40 attached to and forming a part of machine 10'. Mortising plate 40 includes in the upper surface thereof a plurality of lengthwise T-slots 41 for receiving one or more clamps 42 either for holding a work piece 48 against the back flanged surface 43 of plate 40 or for a work piece stop. A work piece 48 may be held (clamped) horizontally, on edge or flat or at an inclined angle. Vertical members 44 are attached to sliding bar carrier 13 as at T-slots 28 and 29 (see FIG. 2) and support mortising plate 40 as at T-slots 45 using threaded clamping knobs 46. Attachment of mortising plate 40 to sliding bar carrier 13 as just suggested allows lateral movement of mortising plate 40 and a work piece 48 clamped thereon beneath and past the cutting tool 35 (not shown in FIG. 3; see FIG. 1). In addition, cutout 47 in the back of flanged surface 43 of plate 40, when positioned at cutting tool location 49, allows the bit of cutting tool 35 to be pulled through the cutout 47 then through the work piece for crosscut operations either perpendicular to a work piece edge or at an angle set by guide plate elements 75 and 76 (see discussion below relative to FIG. 4). In another aspect of the structure, mortising plate 40 may be alternatively structured to extend cutout 47 into a portion of the upper (horizontal) surface of plate 40 adjacent flange 43 at the location of the cutout 47 as depicted in FIG. 3. Extending cutout 47 into the upper surface of mortising plate 40 permits cuts to be made on the end of work piece 48 with the work piece held vertically up through the extended cutout, as well as on the edge and face of work piece 48 with the work piece held horizontally on the upper surface as shown in FIG. 3. Mortising plate 40 can then be beneficially used to cut both the mortise and the tenon of a traditional mortise and tenon joint using the same setup, that is, without removing or repositioning mortising plate 40. To position and hold the work piece vertically for tenon cuts, a fence and toggle type clamp can be attached to slots in the vertical surface of mortising plate 40 below the cutout 47. This arrangement allows use of machine 10' in cutting an almost limitless range of mortises, tenons, dados, grooves and other joinery in the fabrication of cabinetry or the like.

Figure 15:
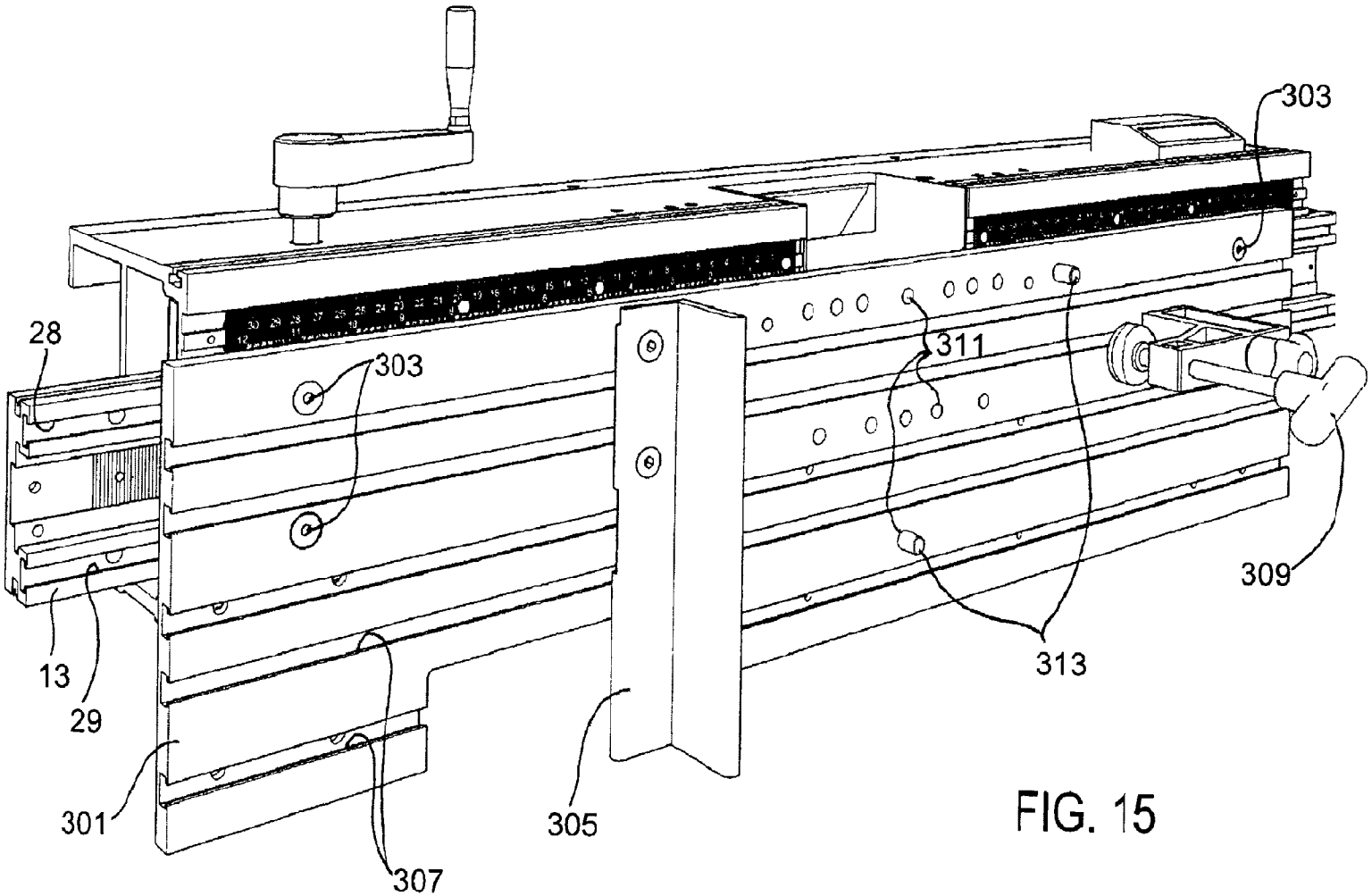
FIG. 15 a perspective view of the slotted mortising plate of the invention disposed vertically with respect to the movable carrier.

It is noted with reference again to FIG. 3, that in the embodiment shown therein, mortising plate 40 may comprise a single extrusion including the horizontal slotted member 41 and the vertical (as FIG. 3 is viewed) flanged member supporting surface 43. In an alternative embodiment, the slotted horizontal member 41 may comprise a first extrusion and back flanged member 43 may comprise a second extrusion, the two extrusions joined at right angles as suggested in FIG. 3 in perpendicular relationship using two or more right angle brackets 343 joining the horizontal member and back flanged member using machine screws 344. The versatility and range of work holding options of the woodworking machine may be substantially expanded by removing the horizontal and vertical flanged members and attaching the slotted horizontal member vertically (as FIG. 3 is viewed) directly to sliding bar carrier 13. The arrangement as shown in FIG. 15 results.

In the embodiment discussed above with respect to FIG. 3, the mortising plate 40 may comprise a slotted horizontal disposed member 41 attached to a vertically disposed member 43. With reference now to FIG. 15, shown therein is an alternative embodiment wherein a grooved mortising plate member identified as 301 (similar to the horizontally disposed grooved member 41 of FIG. 3) may be attached directly to movable carrier 13 in the vertical arrangement shown as at T-slots 28 and 29 using suitable attachment bolts such as at 303. A fixed fence member 305 may be attached to member 301 as suggested in FIG. 15 or otherwise at selected position (s) along member 301 and used similarly to fixed jaw member 23 (FIG. 1). Spaced apart longitudinally disposed T-slots 307 are provided in order to accommodate the attachment to mortising plate member 301 of clamping means such as that shown in FIG. 15 as universal track (or toggle) clamp 309. A plurality of angle locating holes 311 may be provided in the surface of member 301 for receiving two or more locator pins 313. Placement of locator pins 313 in selected angle locating holes 311 will define a large range of bevel cutting angles on a workpiece clamped to member 301.

In the normal (horizontal) setup (namely, FIG. 3), the mortising plate may beneficially be used for holding a workpiece horizontally for operations such as cutting mortises and panel grooves for a door stile. In the vertical (FIG. 15) setup, the mortising plate may beneficially be used for holding a workpiece vertically or at a miter angle for joinery operations such as tenons, dovetails, raised panels, etc.

Figure 4:
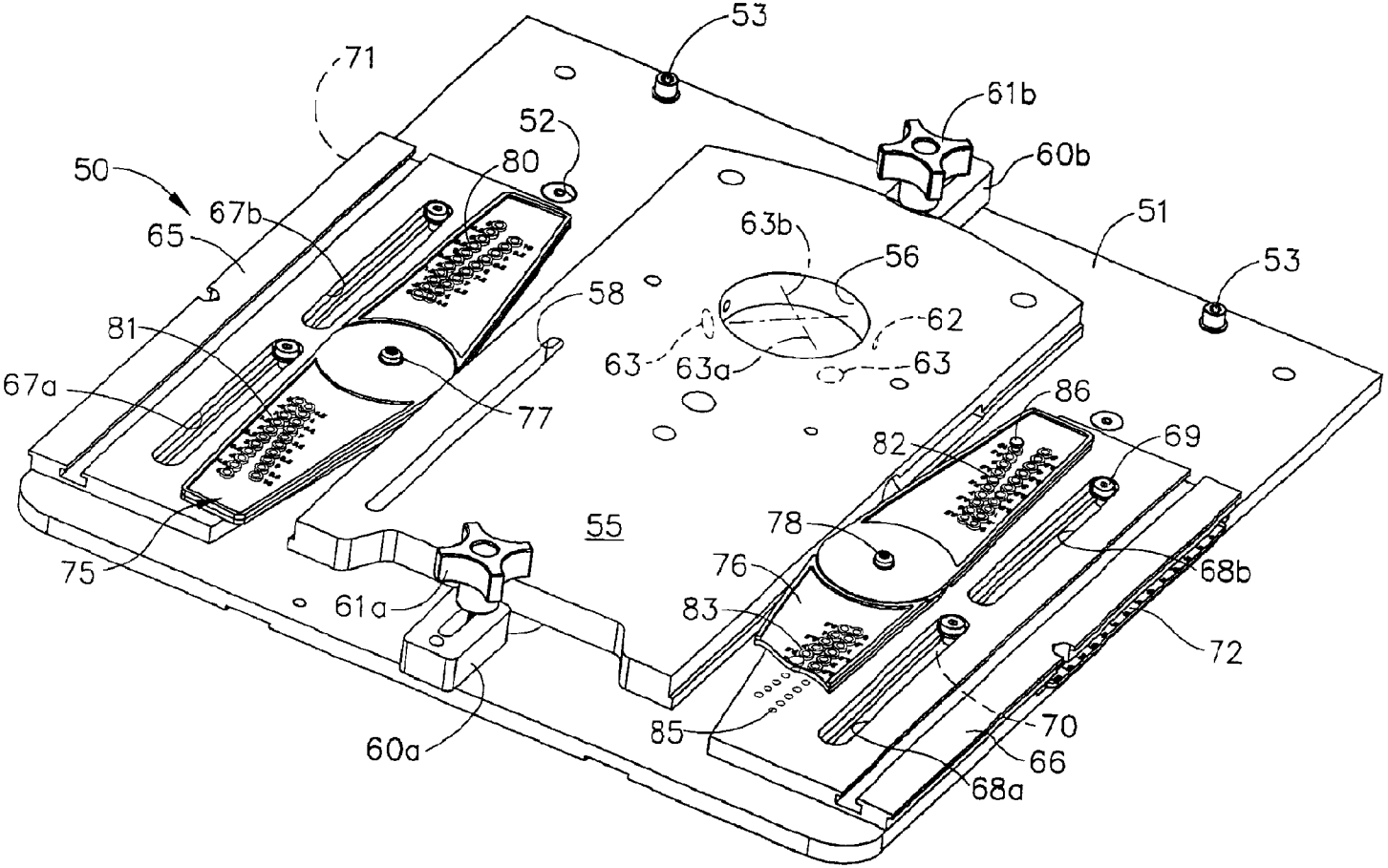
FIG. 4 is a view in perspective of the mounting plate assembly for supporting a cutting tool such as a router in accordance with the invention.

Reference is now made to FIG. 1 in conjunction with FIG. 4, which is a view in perspective of a mounting plate assembly 50 for supporting a cutting tool 35, such as a wood router, on machine 10 or 10' in accordance with the invention. Plate assembly 50 includes a base plate 51 attachable to extrusion 11 as at machined holes 52 (FIG. 4) using one or more bolts as at 53 (FIG. 1 and FIG. 4). Plate 55 (hereinafter referred to as router plate 55) is slidably mounted on base plate 51 for supporting a cutting tool 35 such as a router attached thereto. Router plate 55 has a hole 56 defined therein through which a cutting tool bit such as router bit 57 is extendable to contact work piece 24 (FIG. 1) or 48 (FIG. 3) during a cutting operation. Plunge assist bar 37 controls vertical movement of router bit 57 against a work piece clamped beneath plate assembly 50. Front plunge assist post 37*a* may be included on router plate 55 to assist the user of the machine to manually deploy router bit 57 downwardly against a work piece (FIG. 1 #24 or FIG. 3 #48), by squeezing between his thumb and fingers, plunge bar 37 and a bar on post 37*a*. Right and left rear plunge assist posts 37*b*, included on router plate 55 with a connecting cross bar, operate with plunge bar 37 to assist in depth of cut control. Stop 38 and the plunge lock of cutting tool 35 (the router) can be selectively used to set depth of cut for bit 57. Alternatively, depth of cut of bit 57 can be precisely set by observing a vertically mounted digital scale 39 attached to the front of cutting tool 35. Slot 58 is provided in router plate 55 for receiving a clamping knob 59 (FIG. 8) that engages threaded holes in base plate 51 for selectively locking the position of router plate 55 on base plate 51. Stops 60*a* and 60*b* and clamping knobs 61*a* and 61*b* (FIG. 4) may be included for limiting forward and backward extent of movement of router plate 55, and thereby control the length of cross cut on work piece 24 by selectively limiting the travel of cutting tool 35 across the work piece. One or more small lights such as light emitting diodes 62 may be provided in the wall defining cutting tool hole 56 for illuminating the work piece and tool bit 57 or a pattern board at the point of contact between tool bit and work piece. A pair of laser sources 63 may also be provided in the wall defining cutting tool hole 56 for emitting intersecting beams 63*a* and 63*b* for precision cross hair positioning of the cutting tool bit 57 center point relative to a work piece or pattern board disposed below cutting tool 35. Base plate 51 and router plate 55 may be comprised of any suitable material, such as aluminum, phenolic or acrylic. Battery pack 95 (FIG. 1) may be used to power the laser sources 63 and light emitting diode light sources 62.

Figure 13:
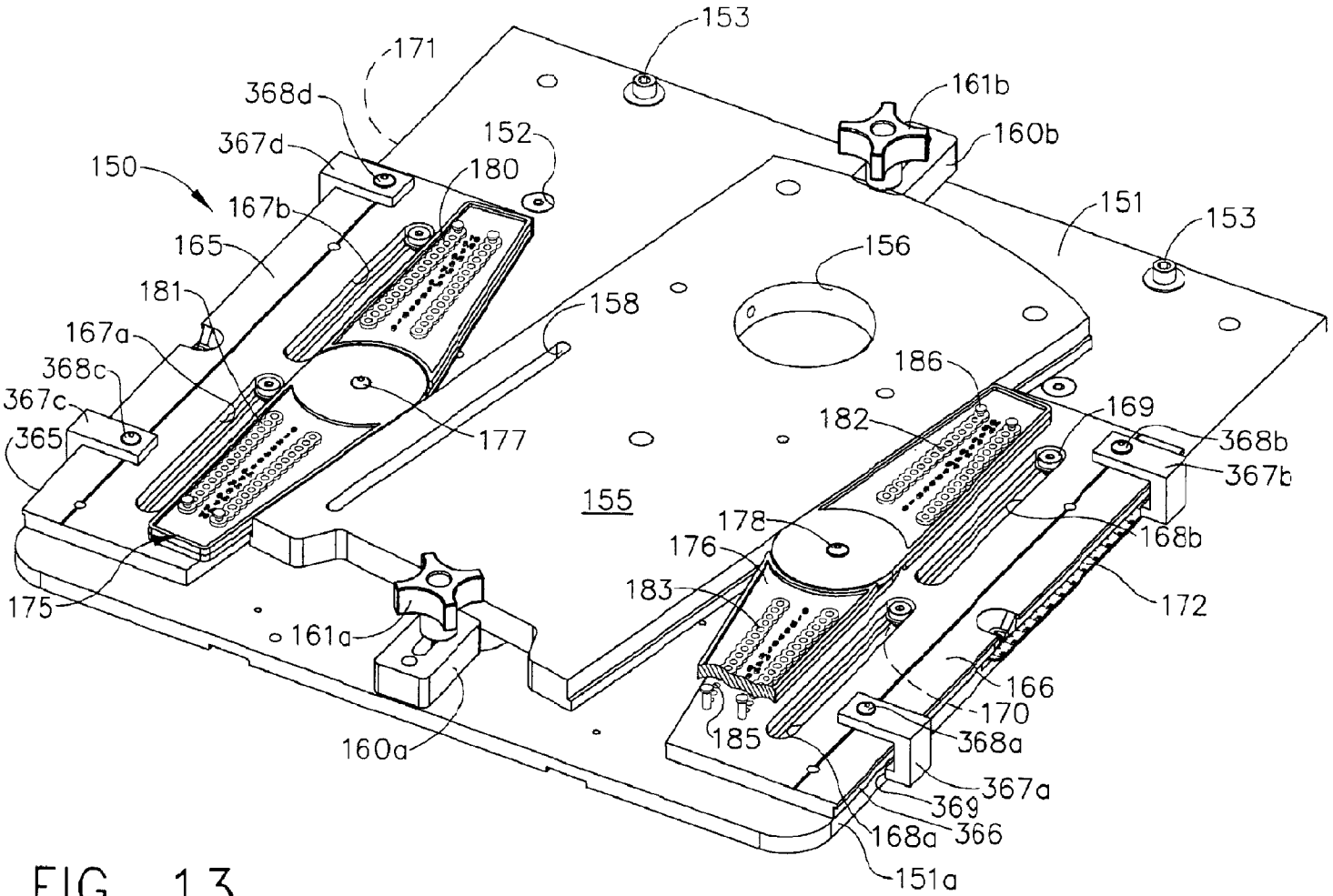
FIG. 13 is a view in perspective of another embodiment of the mounting plate assembly for supporting the cutting tool in accordance with another aspect of the invention.

Referring now specifically to FIG. 4, in conjunction with FIG. 13, shown therein are perspective views of the mounting plate assembly of the invention for supporting the cutting tool in accordance with two aspects of the invention. In FIG. 13, the various elements of the mounting plate assembly numbered with 100 series three digit numbers shown below in parentheses have substantially the same respective functions as the corresponding two-digit numbers of FIG. 4. Accordingly, in FIG. 4, intermediate plates (such as of aluminum or plastic) 65 and 66 (165 and 166 in FIG. 13), are supported on base plate 51 (151 in FIG. 13) and selectively positionable thereon by way of slots 67*a*, 67*b*, 68*a* and 68*b* (167*a*, 167*b*, 168*a*, 168*b* in FIG. 13) utilizing set screws such as 69 (169) that engage corresponding threaded holes in base plate 51 (151) such as represented at 70 (170). Scales 71 and 72 (171, 172) may be disposed on or attached to base plate 51 (151) to set the distance to the center of intermediate plates 65 and 66 (165, 166) from the face of the machine when cutting dovetail pins (see FIG. 7 and FIG. 1). This distance determines the width of a pin and, therefore, the tightness of fit in the mating socket. It locates the point at which the router pivots in cutting the first and second angled sides of a pin. For any angle of cut, as this distance from the face of the machine increases, the pin cuts widen. As the distance decreases, the pin cuts narrow. The proper distance is based on the width of bits used for both the socket and pin cuts and can be determined from a chart or calculator. Slight adjustments in this distance can be used to change the tightness of fit of the joint.

With reference again to FIG. 4 and FIG. 13, it is noted that scales adhered to or permanently attached to guide plates is a deficiency in previously existing woodworking machines leading to inaccuracies. By permanently attaching scales, as in prior art machines, any tolerances in the placement of the scales or machine tolerances in the parts to which they are mounted translate into inaccuracies. To set intermediate plates 65 and 66 (165, 166) at the proper distance from the machine face, this invention uses metal scales 71 and 72 (171, 172) that are mounted with screws in elongated mounting holes allowing user repositioning of the scales to perfectly align them with the face of the machine. With accurately positioned scales, the chart or calculator used to determine distance provides consistent results for all machines.

First and second guide plates in the form of first and second guide plate elements 75 and 76 (175 and 176 in FIG. 13) are disposed on respective intermediate plates 65 and 66 (165, 166) as suggested in FIG. 4 (and with corresponding 100 series numerals in FIG. 13). Each guide plate element 75 and 76 (175, 176) is pivotable on its respective intermediate plate 65 or 66 (165, 166) about respective pivot pins 77 and 78 (177, 178). A space is defined between guide plate elements 75 and 76 (175, 176) in which router plate 55 (155) is selectively movable in moving cutting tool (router) 35 across a work piece such as represented at 24 in FIG. 1 in one of the cutting operations that can be performed using machine 10. Each guide plate element 75 and 76 in the FIG. 4 embodiment have defined therein sets of spaced apart holes 80 and 81 in element 75 and 82 and 83 in element 76. Sets of corresponding holes in respective intermediate plates 65 and 66 as represented at 85 are defined beneath each respective set of holes 80, 81, 82 and 83 as represented at 85 and showing a portion of the guide plate element 76 cut away in order to show holes 85. It should be noted that in the FIG. 13 embodiment, spaced apart holes 180 and 181 in element 175 and 182 and 183 in element 176 are aligned differently from the corresponding holes in the FIG. 4 embodiment. Each set of holes in the guide plate elements 75 and 76 of FIG. 4 or 175 and 176 of FIG. 13 are disposed with respect to corresponding set of dowel pin holes CNC drilled or injection molded in the intermediate plates 65 and 66 (165 and 166 in FIG. 13) so that a dowel pin (such as represented at 86 in FIG. 4) or a pair of dowel pins 186 (such as represented in FIG. 13) may be inserted into a selected hole (FIG. 4) or selected pair of holes (FIG. 13) of each set of holes 80, 81, 82 and 83 (180, 181, 182, 183 in FIG. 13) in the guide plate elements 75 and 76 (175, 176) to align with a corresponding hole in the respective intermediate plates 65 and 66 (165, 166). Placement of the pins 86 or pairs of pins 186 serve to define a specific angle for each guide plate element 75 and 76 (175, 176 in FIG. 13) at which router plate 55 will move with tool bit 57 in contact with a work piece (e.g., #24). Each set of holes 80-83 in the guide plate elements 75 and 76 and the corresponding set of holes in the respective intermediate plates 65 and 66 permits pivoting of each guide plate element 75 and 76 about its respective pivot pin 77 or 78 in fractional (one-half) degree increments between zero degrees and plus or minus 10 degrees (shown in FIG. 4). The alignment of spaced holes 180, 181, 182 and 183 in guide plate elements 175 and 176 and the corresponding holes 185 in intermediate plates 165 and 166 are different from the alignment of respective corresponding holes in the embodiment of FIG. 4 in order to accommodate pins 186 in pairs in each wing of guide plate elements 175 and 176 as depicted in FIG. 13. For any given hole 83 in elements 75 and 76 or pair of holes 183 in elements 175 and 176, there is only one hole or pair of holes in the corresponding intermediate plate 65 or 66 (FIG. 4) and 165 or 166 (FIG. 13) in which the dowel pin (represented by #86 in FIG. 4 and or pair of pins 186 in FIG. 13) will fit. The position of the dowel pins fix each element 75 and 76 of FIGS. 4 and 175 and 176 of FIG. 13 to the corresponding intermediate plate 65 and 66 and 165 and 166 respectively at a characteristic angle, and guide plate elements 75 and 76 (FIG. 4) and 175 and 176 (FIG. 13) then provide a straight edge against which the router plate 55 or 155 can be guided at the prescribed angle. Use of the two pins 186 in the assembly 150 of FIG. 13 is beneficial in minimizing the effects of any design or manufacturing tolerances in the various elements of the assembly.

Barrel nuts 77 and 78 (FIG. 4) and 177 and 178 (FIG. 13) lock in place the respective guide plate elements 75 and 76 or 175 and 176. The barrel nuts of each assembly 50 and 150 are secured in elongated slots in the respective intermediate plates allowing space defined between guide plate elements 75 and 76 to vary depending on the specific angle set for guide plates 75 and 76. Accordingly, insertion of the dowel pins establishes both the angle and the defined space between the guide plate elements when the router plate is rotated against the guide plate elements and the barrel nuts are then tightened. Rotating the straight edge of the router plate against the straight edge of the guide rails with the pins (or pin pairs) in place brings all the elements into alignment and tightening of the barrel nuts holds the elements in place.

Figure 5:
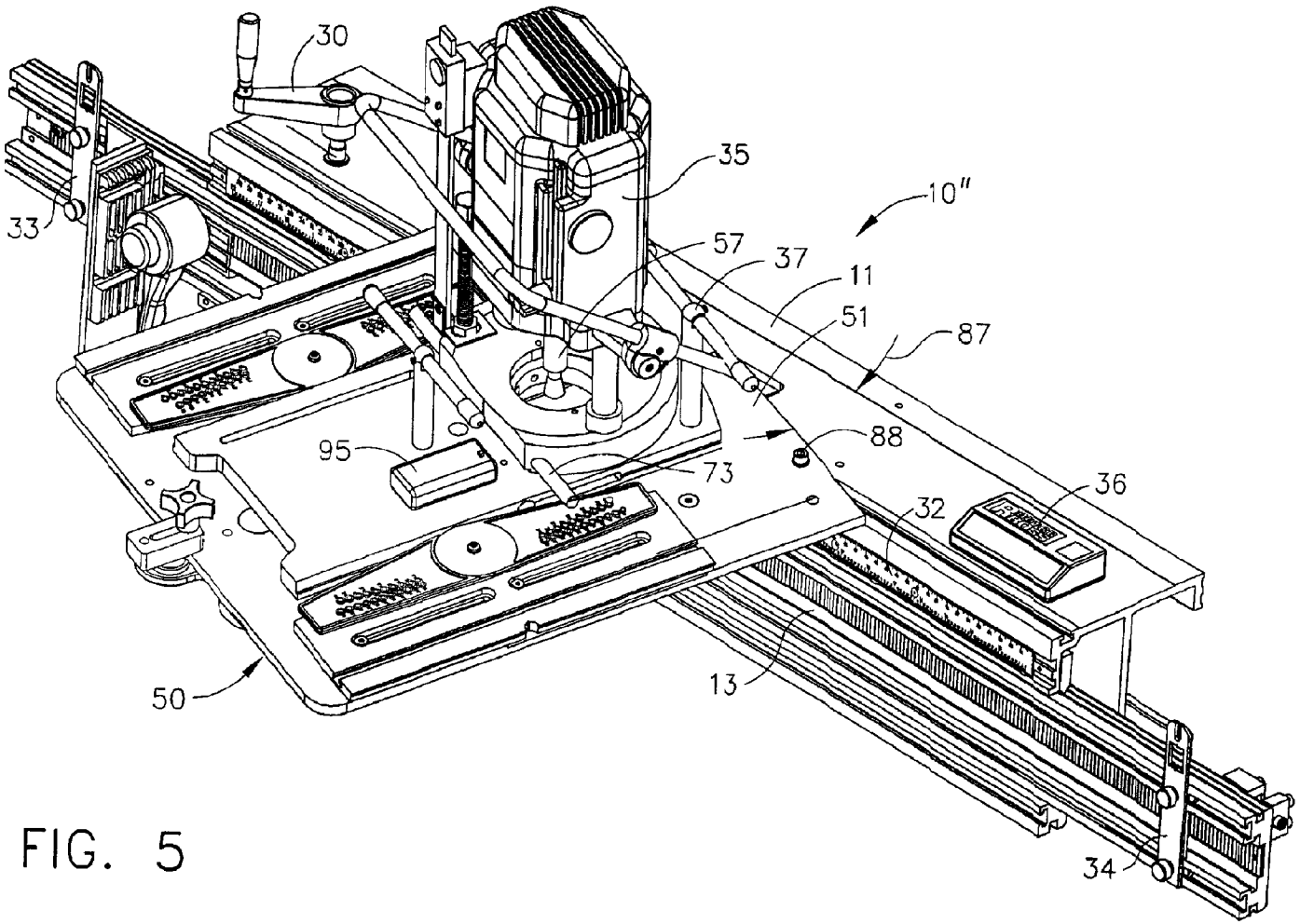
FIG. 5 shows an alternate arrangement for the wood working machine of FIG. 1.

With reference now to FIG. 5, which shows an alternate arrangement 10" for the wood working machine of the invention, it is seen that base plate 51 and extrusion 11 may be configured to permit base plate 51 to be secured such as by bolts 88 at a selected angle 87, as suggested in FIG. 5. If base plate 51 is then configured to be attachable to extrusion 11 at 20 degrees as suggested in FIG. 5 in either direction (i.e. plus or minus 20 degrees with respect to the length of extrusion 11), the range of angles permitted by selectively positioning guide plate elements 75 and 76 (see above discussion relative to FIG. 4) is in one-half degree increments between plus or minus 30 degrees. The cutting direction of cutting tool (router) 35 may therefore be selectively set at any desired angle in one-half degree increments between plus or minus 30 degrees with respect to the length of extrusion 11 and movable carrier 13.

Referring now further and specifically to FIG. 13, it is noted that intermediate plates 165 and 166 (see also plates 65 and 66 in FIG. 4) are manufactured so that their outer edges 365 and 366 align flush with the respective sides (e.g. 151*a*) of base plate 151 (plate 51 in FIG. 4) when the guide plate elements 75 and 76 in FIG. 4 are set to zero degrees as for cutting dovetail sockets (FIG. 6) with a dovetail bit and their inside edges are flush against side of router plate 55 (with plate 55 positioned as in FIG. 4). As explained above, the inside edges of guide plate elements 75 and 76 retract and are no longer flush against router plate 55 when the guide plate elements 75 and 76 are set to the dovetail bit angle for cutting the mating dovetail pins (FIG. 7) with a straight bit. If the intermediate plates 65 and 66 are correctly positioned on scales 71 and 72 in FIG. 4 then the dovetail pins should precisely fit the previously cut dovetail sockets. Referring again to FIG. 13, to adjust tightness of pin fit the intermediate plates 165 and 166 can be repositioned forwardly or backwardly on base plate 151 and scales 171 and 172, but, since the angled router plate 155 cannot be used as a guide, the machine user must visually or by feel keep the intermediate plates 165 and 166 in edge alignment with the respective side edges of base plate 151. In order to maintain the proper and consistent alignment of intermediate plates 165 and 166 at various positions along base plate 151, U-shaped brackets 367*a, b, c* and *d* may be attached as by captive nuts in the under surfaces of plates 165 and 166 and machine screws 368*a, b, c* and *d* received through elongated slots provided near the respective first ends of brackets 367 as suggested in FIG. 13. Surfaces at the second ends of brackets 367 as exemplified by surface 369 on bracket 367*a* are configured to contact the edge 151*a* of plate 151 and tightened as at screws 368 to firmly and properly align plates 165 and 166 on plate 151 at all positions of plates 165 and 166.

It is noted that the setup depicted in FIG. 4 may be used for cutting dovetail pins and sockets. For most dovetails, a zero to ten degree angle on the elements 75 and 76 as configured in FIG. 4 provides sufficient flexibility for the machine. Sockets are cut with a dovetail bit and router plate SS perpendicular to the machine face with elements 75 and 76 set at a zero degree angle. Pins are then cut with a straight bit with elements 75 and 76 set to an angle that matches the dovetail bit angle, with seven, eight and ten degrees being common. However, other type joints in the fabrication of cabinetry or furniture may require angled cross cuts greater than ten degrees. Accordingly, base plate 51 may be set at zero degrees (perpendicular to the machine face) or twenty degrees clockwise or counterclockwise as just described with respect to FIG. 5 that results in precise angle control in one-half degree increments within a sixty degree span from −30 degrees to +30 degrees. Other fractional degree increments could be selected and are considered within the scope of these teachings and the appended claims, the selected one-half degree increments being considered to provide a sufficient range of angle settings for substantially all operations.

The guide plate elements 75 and 76 may be accurately and inexpensively manufactured (such as by injection molded plastic). It is important to note that both the pins and sockets of the dovetail joint may be made without repositioning the intermediate plates 65 and 66 between socket cuts and pin cuts. The positioning of guide plate elements 75 and 76 provides flexibility, accuracy and repeatability so that the router (cutting tool 35) and router plate 55 can be set precisely at a desired angle and the angle can be changed, such as between socket and pin cuts, then precisely returned to the desired angle by replacing a dowel pin in its original position.

Figure 6:
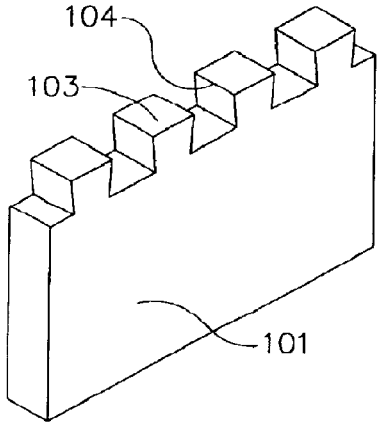
FIG. 6 illustrates the configuration of dovetail sockets that can be cut using the invention.
Figure 7:
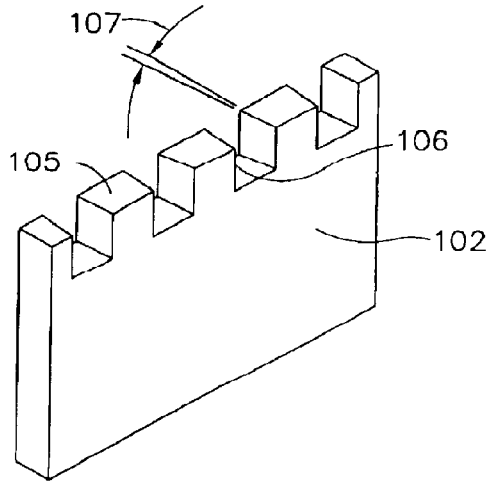
FIG. 7 illustrates the configuration of dovetail pins that can be cut using the invention.

Referring now to FIG. 6 and FIG. 7, shown therein are respective dovetail sockets and dovetail pins representative of those that can be cut using the invention. In FIG. 6 there is shown the end profile of a work piece 101 having dovetail sockets 104 cut therein such as by using machine 10 and a dovetail bit on cutting tool 35 selected to define a specific cutting angle for sockets 104. In FIG. 7 there is shown a series of dovetail pins 105 in work piece 102 that can be cut using a straight bit wherein the angle 107 defining the gaps 106 between the pins 105 is selected in accordance with the procedures described above with respect to the positioning of base plate 51, intermediate plates 65 and 66, and guide plate elements 75 and 76.

With reference again to FIG. 4 and FIG. 5, it is noted that the need to interchange or to reverse the positions of the guide plate elements between socket and pin cuts is a deficiency in previously existing wood working machines leading to almost certain inaccuracies. By reversing the plates as in prior art machines, any tolerances in the manufacture of the plates and their mountings or in the repositioning of the plates (shift in pivot point) translates into inaccuracies in the resultant cuts as between pins and mating sockets and an inevitable mismatch in the resulting dovetail joint profiles (FIG. 6 and FIG. 7). Because the intermediate plates 65 and 66 of the invention as defined with respect to FIG. 4 are not repositioned (i.e., reversed), between socket and pin cuts, the cuts in both the x (side to side) and z (front to back) directions (in the plane of the guide plate elements) are kept precise even if a switch is made back and forth multiple times between socket and pin cuts when cutting numerous joints.

Figure 8:
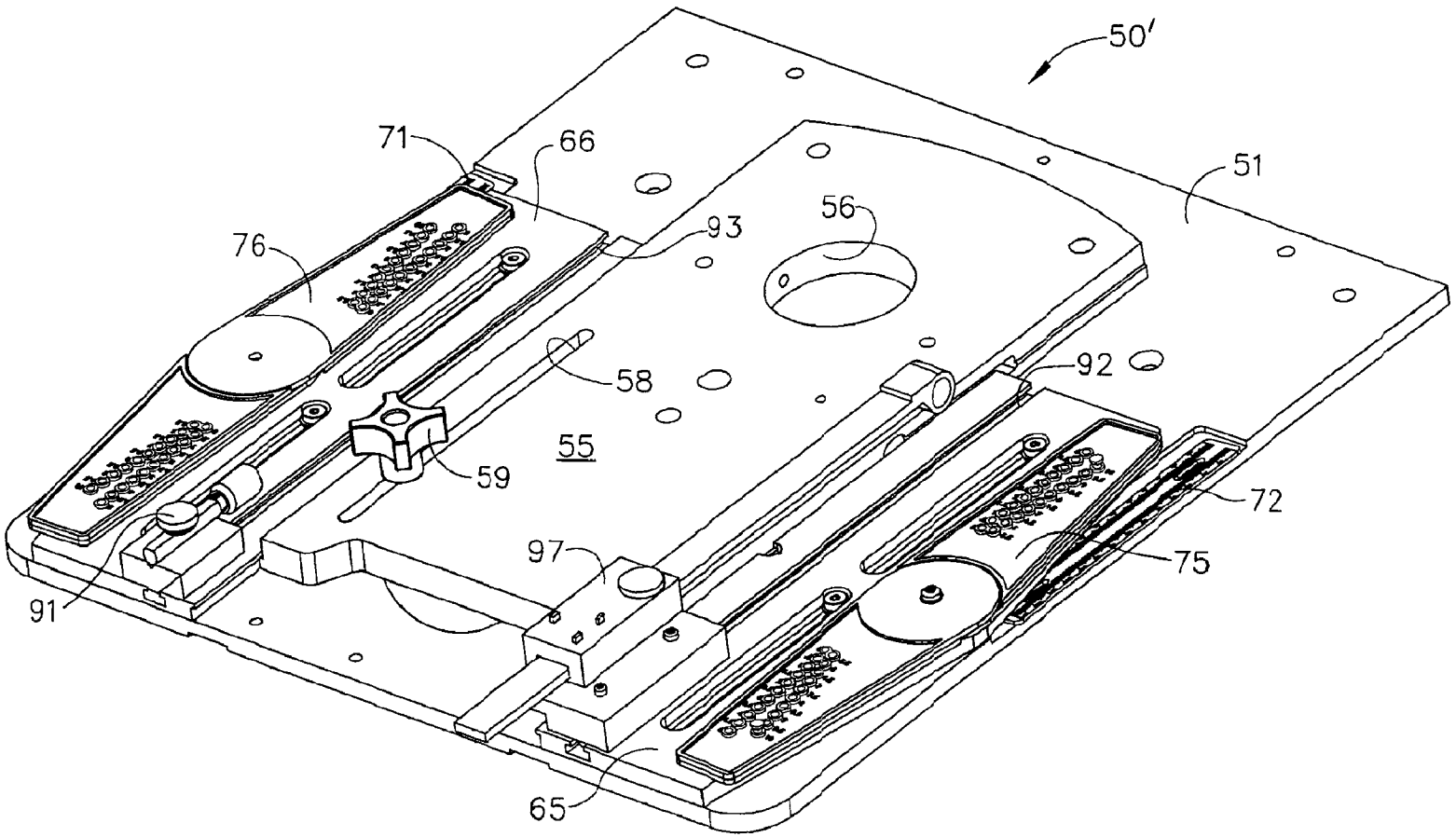
FIG. 8 shows a perspective view of an alternative arrangement for mounting the plate assembly supporting the cutting tool.

Referring now to FIG. 8, shown therein is a view in perspective of an alternative arrangement for the mounting plate assembly 50' useful in association with wood working procedures utilizing the wood working machine described herein. The assembly 50' depicted in FIG. 8 may be useful especially for straight line cuts along the z axis (the direction parallel to mounting plate assembly 50), whereas the arrangement of FIG. 4 is primarily configured for dovetail or other angular joints. In assembly 50', the intermediate plates 65 and 66 with the corresponding guide plate elements 75 and 76 mounted thereon are reversed in position on base plate 51. A space is therefore defined between intermediate plates 65 and 66 to guide movement of router plate 55 therebetween along the z direction on base plate 55. Limits on movement of router plate 55 on base plate 51 can be provided by one or more micro adjustable stops 91 selectively positioned within and along T-track slots 92 or 93 defined in respective intermediate plates 65 and 66 as suggested in FIG. 8. The stops work against a stop bar 73 (FIG. 1 or FIG. 5) that is part of or attached to cutting tool 35. Quick and precise movement of the cutting tool can be provided by inserting a gauge bar (not shown) of known thickness between stop 91 and stop bar 73 then removing the gauge bar and moving the cutting tool to the stop. An alternative way to control precise movement of the cutting tool in this (the z-) axis can be provided by a digital scale 97 disposed within T-track slots 92 or 93 in respective intermediate plates 65 and 66 and affixed to stop bar 73. In another aspect of the invention, intermediate plates 65 and 66 are inexpensively manufactured from injection molded plastic and do not include the t-tracks slots 92 or 93. Instead, the t-track slots are included in optional extruded aluminum straight guide rails that do not include the variable angle guide rail elements 75 and 76. In this implementation the extruded aluminum guide rails mount on base plate 51 in the same way as the guide rails 65 and 66 shown in FIG. 8 and are used in place of the guide rails 65 and 66 to guide movement of router plate 55 therebetween along the z direction on base plate 55 and to provide mounting for stop 91 and digital scale 97 or other accessories.

Figure 10:
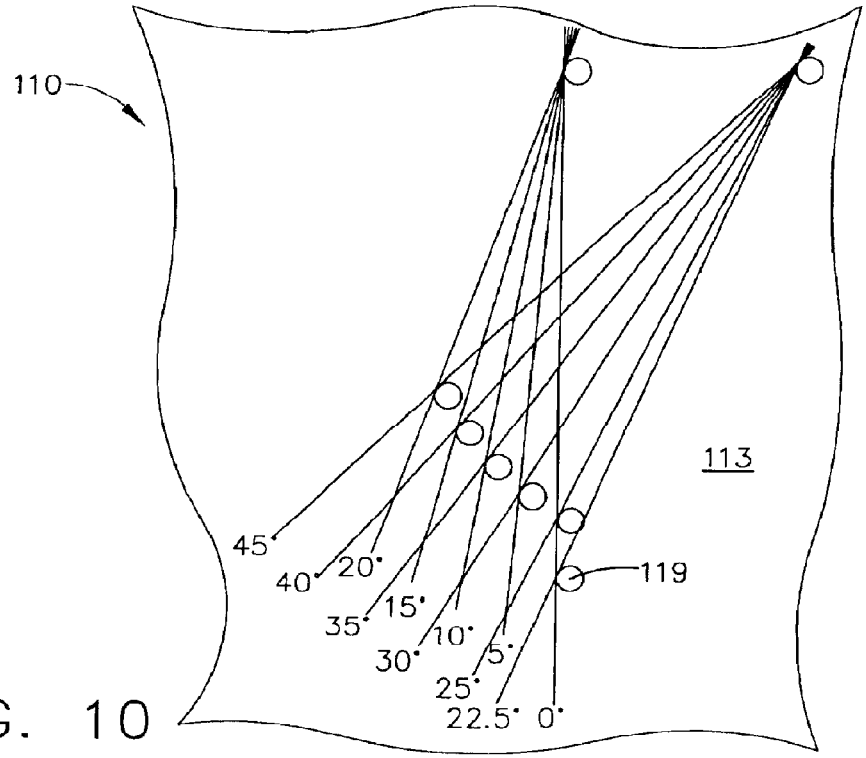
FIG. 10 shows the alignment of locator pin holes in the FIG. 9 jig that defines a range of compound cutting angles using the jig.
Figure 9:
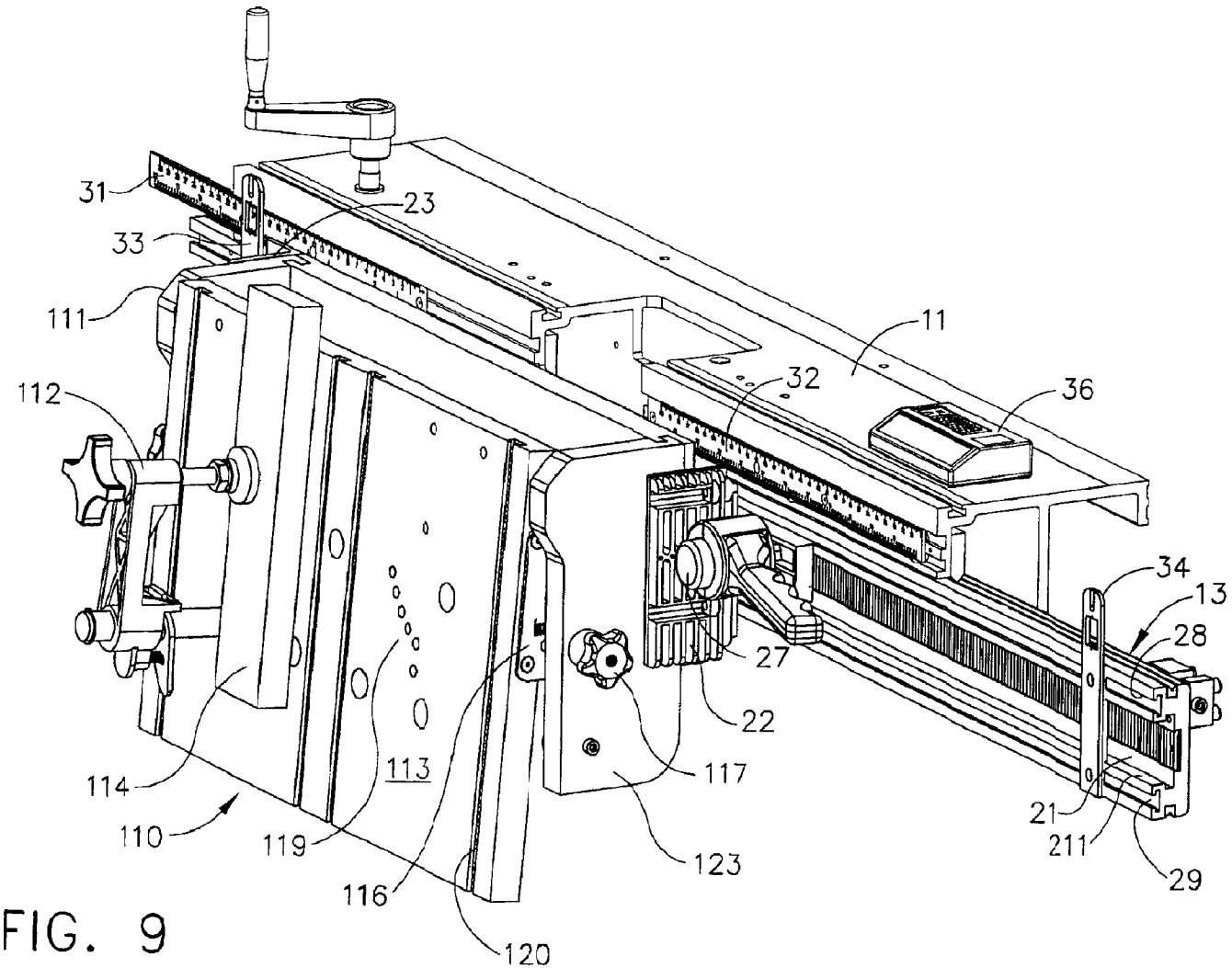
FIG. 9 shows a perspective view of a pivotable multiangle work holder jig attachable to the woodworking machine according to the invention.

Referring now to FIG. 9, shown therein is a perspective view of a pivotable multiangle work holder jig 110 that may be pivotally attached to a woodworking machine structure (such as 10 of FIG. 1). It is seen that the platform surface of jig 110 may be pivotally mounted as at 111 to a box structure 123 that is attachable to movable carrier 13. Locator pins selectively inserted in positioning holes drilled in back of jig 110 rest on ledge 211 in lengthwise groove 21 of carrier 13 (see FIG. 1) to level jig 110 and set mounting height. Clamp 112 is removably attachable to jig 110 platform surface 113 for supporting a work piece 114. Jig 110 is selectively positionable beneath mounting plate assembly 50 to define a cutting angle at which surface 113 supporting the work piece 114 is held. The cutting angle is defined as at protractor 116 and the jig 110 mounted on box structure 123 may be held in position between cam lock 27 moveable jaw 22 and fixed jaw 23 attached to carrier 13 as described above in relation to FIG. 1. A compound cutting angle may be defined by both protractor 116 and locator pins selectively inserted in holes 119 in surface 113 that represent predefined angles from zero to 45 degrees in five degree increments plus 22.5 degrees as shown in FIG. 10. It is immediately seen that cuts on work piece 114 at the upper end thereof can be made at substantially any angle along the x or z directions as defined above or the y direction (the direction perpendicular to mounting plate assembly 50). Vertical T-track slots 120 in surface 113 allow a shop-made rail to be disposed on jig 110 on which toggle clamps can be attached to provide an alternative work holding method for supporting and clamping work piece 114 horizontally on jig 110 at single or compound angles.

Figure 11:
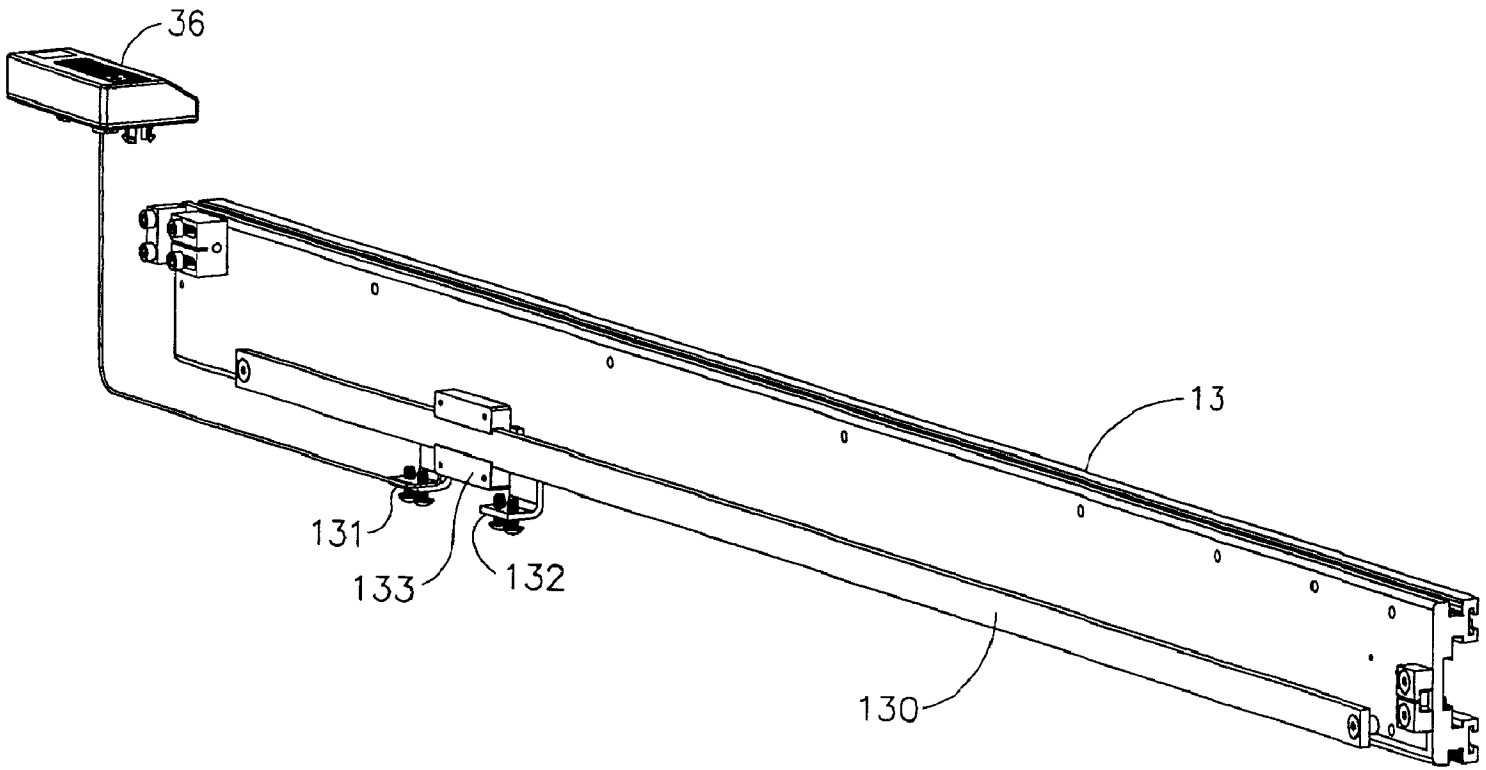
FIG. 11 shows the component parts of a digital readout attached to the sliding bar carrier of the machine of the invention.

Referring now to FIG. 11, shown therein a view in perspective of the component parts of a digital readout arrangement that may be attached to the back side of sliding bar carrier 13 of, for example, machine 10 of FIG. 1. In FIG. 11, a digital beam 130 is attached to the back of carrier 13 and moves with carrier 13 between a pair of stops 131 and 132. A stationary digital sensor 133 located between stops 131 and 132 senses the movement and position of beam 130 and sends signals to digital display 36 related to the position of beam 130 as it moves with carrier 13.

Figure 12:
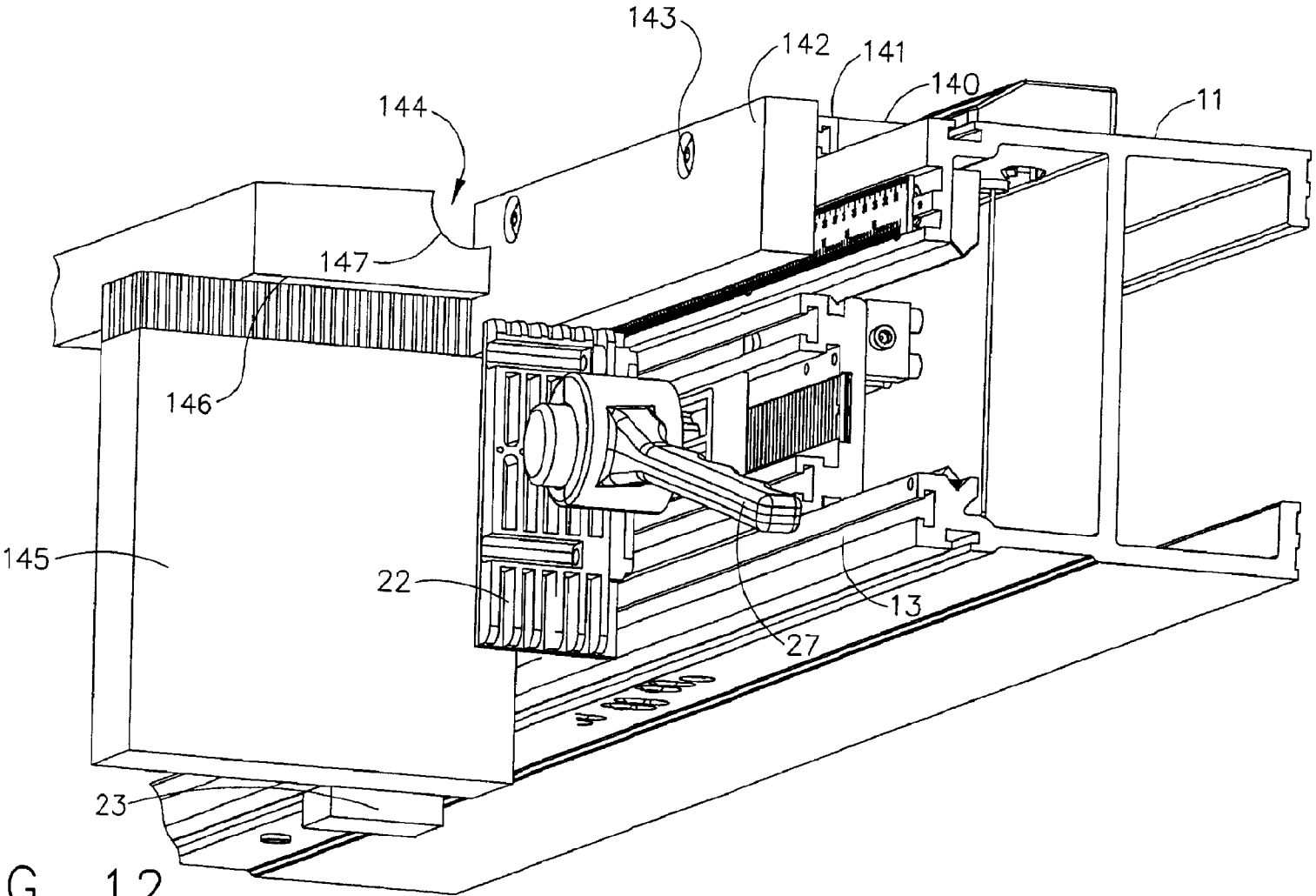
FIG. 12 shows a perspective view of a fence and bristle brush attachable to the woodworking machine to support hand feeding of a work piece in accordance with the present invention.

Referring now to FIG. 12, shown therein is a perspective view of a fence and bristle brush arrangement attachable to the woodworking machine of the invention that may be used to support hand feeding of a work piece for edge profiling using the machine. Accordingly, a riser plate 140 is provided to rest between extrusion 11 and base plate assembly 50. A T-slot extrusion 141 is attached to the edge of riser plate 140 and has attached thereto a two piece fence 142 using set screws 143 that engage nuts in T-slot extrusion 141. An opening 144 is defined between the two pieces of fence 142 to accommodate the deployment of a cutting tool bit, such as bit 57 of FIG. 1. A hog bristle brush 145 is clamped between fixed fence 23 and movable fence 22 and cam lock 27 attached to carrier 13. Brush 145 holds work piece 146 against the lower surface of base plate 51 as the work piece is hand fed against the cutting tool bit in performing an edge profiling operation on work piece 146 as at profile 147, and at the same time prevents kickback of the work piece resulting from contact with the tool bit. An alternative arrangement is to use a wide or double feather board made from plastic or other suitable material that is attached to t-slots 307 on mortising plate member 301 mounted on carrier 13 as in FIG. 15.

Figure 14:
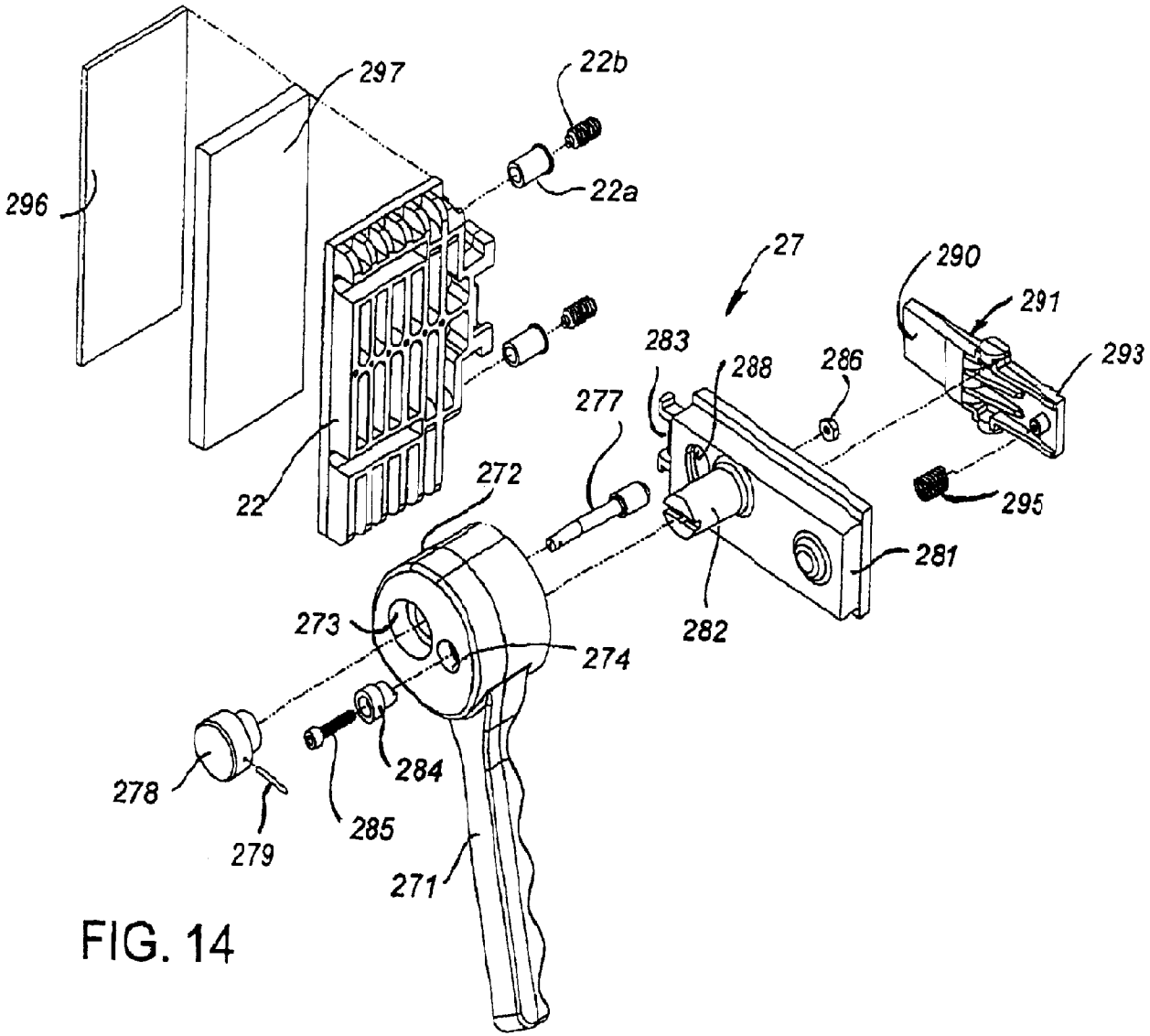
FIG. 14 is an exploded view of the rotatable cam lock useful for securing a work piece in the woodworking machine according to the invention.

With reference now to FIG. 14, shown therein is an exploded view of the rotatable cam lock 27 useful for securing a work piece within woodworking machine 10. Exemplary use of cam lock 27 is depicted in FIG. 1 as securing a work piece 24 between fixed jaw 23 and second movable jaw 22 along toothed track 20 of wood working machine 10 by operative engagement of cam lock 27 with movable jaw 22. Threaded inserts **22*a* are inserted into the edge of movable jaw 22 in order to receive spring plungers 22*b* so as to bias movable jaw 22 against sliding bar carrier 13 and remove any play between movable jaw 22, sliding bar carrier 13 and cam lock 27. In FIG. 14, it is seen that cam lock 27 includes a handle portion 271 having a generally cam shaped top portion 272 with holes 273,274 defined therethrough for receiving certain operative members comprising cam lock 27. Actuator member 277 passes through hole 273 and is received within push button 278 and secured therewithin by pin 279. Cam clamp base 281 includes a hollow post 282 having a slotted upper surface and axial hole for assembly with handle portion 271 via cam clamp handle cap 284, machine screw 285 and threaded nut 286. Cam clamp base 281 has a flanged end 283 for capturing movable jaw 22, which allows jaw 22 to move slightly away from base 281 when cam lock 27 is fully engaged. Accordingly, the assembly of handle 271 with base 281 disposes actuator member 277 through hole 288 and against surface 290 on one end of cam clamp pawl 291. Pawl 291 has teeth 293 on the rear surface thereof as suggested in FIG. 14 in order to engage toothed track 20 on sliding bar carrier 13 (see FIG. 1). Biasing spring 295 between base 281 and pawl 291 operates to bias teeth 293 into engagement with toothed track 20**.

With reference now to FIG. 14 in conjunction with FIG. 1 it is seen that compressing push button 278 operates to push activator member 277 against surface 290 of pawl 291, which causes pawl 291 to pivot about its midpoint and compress biasing spring 295 so as to retract teeth 293 from tooth track 20. This action frees up cam lock 27 and movable jaw 22 to be selectively repositioned along sliding bar carrier 13. Subsequent release of push button 278 allows biasing spring 295 to act against pawl 291 to re-engage teeth 293 with toothed track 20 of carrier 13, and clockwise rotation of handle 271 causes cam shaped profile of top portion 272 of handle 271 to engage with movable jaw 22 to secure workpiece 24 against fixed jaw 23 as depicted in FIG. 1. Counter-clockwise rotation of handle 271 operates to disengage the cam shaped top portion 272 from movable jaw 22 allowing quick removal of the workpiece and readying the cam for insertion of a new workpiece.

A thin layer of rubber 296 on face of both moveable jaw 22 and fixed jaw 23 provides a non-slip surface to prevent slippage of workpiece 24. In another aspect of cam lock 27, tightening of assembly screw 285 causes handle 271 to contact base 281. Further tightening regulates the friction between handle 271 and base 281 to prevent slippage of handle 271 when operated against moveable jaw 22.

It is noted that this cam improves on prior cams used to secure a workpiece between a fixed and moveable fence by the use of multiple teeth 293 on pawl 291 to add strength, placing of assembly screw 285 in a non-rotating cap 284 to prevent loosing, use of screw 285 to regulate friction between handle 271 and base 281, and use of spring plungers 22*b* to prevent play.

This invention therefore provides an improved wood working machine for cutting dovetail joints, mortises, tenons, box joints, raised panels, dados, grooves and other joint configurations, and in performing other wood working procedures in the fabrication of cabinetry or other structures comprising wood. It is understood that modifications to the invention as described can be made by one skilled in the applicable art within the scope of these teachings and of the appended claims. All embodiments of the invention have therefore not been described in detail. Other embodiments, arrangements or modifications can be made without departing from the sprit of the invention or from the scope of the appended claims.

What is claimed is:

1. A woodworking machine, comprising:

(a) a support;

(b) a movable carrier mounted on said support for slidable movement along said support;

(c) a mounting plate assembly attachable to said support for supporting a cutting tool, said mounting plate assembly including a base plate having means for attachment to said support, and including first and second guide rails on said base plate and defining a space therebetween, and including a cutting tool support plate slidably disposed on said base plate within said space between said first and second guide rails, whereby said movable carrier is slidably movable along said support beneath said mounting plate assembly; and (d) a mortising plate attachable to said movable carrier beneath said mounting plate assembly, said mortising plate having a slotted surface for supporting a work piece thereon, wherein said slotted surface is disposable both horizontally and vertically with respect to said movable carrier.

2. The machine of claim 1 wherein said base plate includes means for attachment to said support at two or more angular positions.

3. The machine of claim 1 further comprising means interconnecting said mortising plate and said movable carrier for releasably fixing said mortising plate along said movable carrier relative to said mounting plate assembly.

4. The machine of claim 1 further comprising a clamping means attachable to said mortising plate at said slotted surface thereof for holding a work piece either horizontally, vertically or at an angle.

5. A woodworking machine, comprising:

(a) a support;

(b) a movable carrier mounted on said support for slidable movement along said support;

(c) a mounting plate assembly attachable to said support for supporting a cutting tool, said mounting plate assembly including a base plate having means for attachment to said support, and including first and second guide rails on said base plate and defining a space therebetween, and including a cutting tool support plate slidably disposed on said base plate within said space between said first and second guide rails, whereby said movable carrier is slidably movable along said support beneath said mounting plate assembly; and (d) means for digitally sensing the position of said movable carrier on said support, said means including an elongated beam attached to said movable carrier and adapted for movement therewith, a digital sensor disposed near said elongated beam for sensing the position of said elongated beam, and digital readout means operatively connected to said digital sensor for receiving signals from said digital sensor.

6. The machine of claim 5 further comprising clamping means attachable to said movable carrier for selectively holding a work piece.

7. The machine of claim 6 wherein said clamping means includes a fixable jaw and a movable jaw between which a work piece can be clamped, the movable jaw having an associated cam lock for selectively tightening said movable jaw against said work piece.

8. The machine of claim 5 further comprising a jig platform pivotally mounted to said movable carrier for supporting a work piece thereon at a selected angle beneath said mounting plate assembly.

9. The machine of claim 5 wherein said cutting tool support plate includes means defining an opening therein adapted for movement therethrough of a cutting bit on said cutting tool.

10. The machine of claim 9 wherein the walls defining said opening include therein a pair of laser sources for projecting two intersecting laser beams adapted for selectively positioning said cutting bit relative to a work piece.

11. The machine of claim 9 wherein the walls defining said opening include therein at least one light source adapted for illuminating the cutting bit.

12. The machine of claim 5 further comprising a mortising plate attachable to said movable carrier beneath said mounting plate assembly, said mortising plate having a slotted surface for supporting a work piece thereon.

13. A woodworking machine, comprising:

(a) a support;

(b) a movable carrier mounted on said support for slidable movement along said support;

(c) a mounting plate assembly attachable to said support for supporting a cutting tool, said mounting plate assembly including a base plate having means for attachment to said support, and including first and second guide rails on said base plate and defining a space therebetween, and including a cutting tool support plate slidably disposed on said base plate within said space between said first and second guide rails, whereby said movable carrier is slidably movable along said support beneath said mounting plate assembly; and (d) a selectively positionable scale attached to said support and a selectively positionable cursor attached to said movable carrier and alignable with said scale, said scale and cursor adapted for assessing the position of said movable carrier relative to said cutting tool.

14. The machine of claim 13 further comprising clamping means attachable to said movable carrier for selectively holding a work piece.

15. The machine of claim 13 wherein said clamping means includes a fixable jaw and a movable jaw between which a work piece can be clamped, the movable jaw having an associated cam lock for selectively tightening said movable jaw against said work piece.

16. The machine of claim 13 further comprising a jig platform pivotally mounted to said movable carrier for supporting a work piece thereon at a selected angle beneath said mounting plate assembly.

17. The machine of claim 13 wherein said cutting tool support plate includes means defining an opening therein adapted for movement therethrough of a cutting bit on said cutting tool.

18. The machine of claim 17 wherein the walls defining said opening include therein a pair of laser sources for projecting two intersecting laser beams adapted for selectively positioning said cutting bit relative to a work piece.

19. The machine of claim 17 wherein the walls defining said opening include therein at least one light source adapted for illuminating the cutting bit.

20. The machine of claim 13 further comprising a mortising plate attachable to said movable carrier beneath said mounting plate assembly, said mortising plate having a slotted surface for supporting a work piece thereon.

* * * * *